United States Patent [19]

Foa

[11] 3,930,753

[45] Jan. 6, 1976

[54] DUAL PREROTATOR

[76] Inventor: Joseph V. Foa, 3404 Thornapple St., Chevy Chase, Md. 20015

[22] Filed: July 23, 1974

[21] Appl. No.: 490,967

[52] U.S. Cl. ..... 417/53; 62/5; 137/561 H; 415/101; 417/348

[51] Int. Cl.[2] ..... F04B 19/24

[58] Field of Search ..... 415/71, 72, 73, 101, 103; 417/348, 101, 53; 55/406; 74/857; 137/561 A; 62/5

[56] References Cited

UNITED STATES PATENTS

| | | | |
|---|---|---|---|
| 108,529 | 10/1870 | Snyder | 415/101 |
| 2,058,613 | 10/1936 | Morris | 415/101 |
| 2,905,276 | 9/1959 | Henderson et al. | 415/101 |
| 3,361,336 | 1/1968 | Foa | 417/53 |

FOREIGN PATENTS OR APPLICATIONS

| | | | |
|---|---|---|---|
| 610,572 | 10/1948 | United Kingdom | 415/103 |

*Primary Examiner*—Wendell E. Burns
*Assistant Examiner*—David D. Reynolds

[57] ABSTRACT

The invention relates to a method and apparatus for improving the performance of back-to-back turbocompressor or turbopump systems, or, more generally, of internal-separation energy separators. A helicoidal or spiral baffle is used to impart simultaneously a positive prerotation to the flow which is to be deenergized and a negative prerotation to the flow which is to be energized.

8 Claims, 6 Drawing Figures

DUAL PREROTATOR

The invention herein described was made in the course of or under a contract or subcontract thereunder with the Department of the Navy.

SUMMARY OF THE INVENTION

This invention relates to a method and apparatus for imparting opposite prerotations to the two sub-flows into which the input flow is divided in back-to-back turbocompressor or turbopump systems, or, more generally, in internal-separation energy separators as described in my U.S. Pat. No. 3,361,336, the subject matter of which is incorporated herein by reference.

Theory and experiment have shown that significant improvements in the performance of energy separators, at any given rotor peripheral speed, are obtained when, prior to entering the rotor discharge passage, the sub-flow which is to be de-energized (hereinafter to be referred to as the "cold" flow) is imparted a positive prerotation, i.e., an angular momentum of the same sign as the angular velocity of the rotor, while the sub-flow which is to be energized (hereinafter to be referred to as the "hot" flow) is imparted a negative prerotation, i.e., an angular momentum of the sign opposite to that of the angular velocity of the rotor. I have found a method for imparting both prerotations simultaneously in a single step, with lower flow losses than are generated by conventional guidevanes.

It is, therefore, a principal object of this invention to provide a means for improving the performance of apparatus for pumping, lifting, or compressing of fluids of all kinds, and for heating, cooling, refrigerating, air conditioning and related purposes.

Further objects and advantages of this invention will be apparent from the following description.

THE DRAWINGS

DESCRIPTION OF PREFERRED EMBODIMENTS

Figure 1:
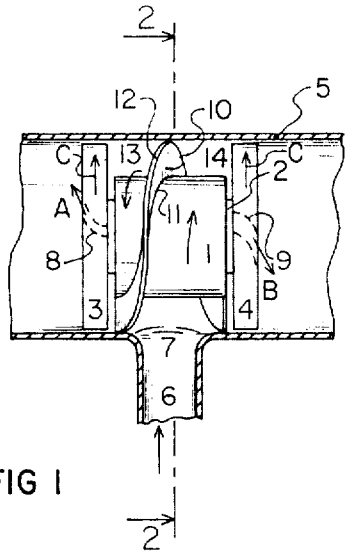
FIG. 1 is a side elevational view, partially in section, of an apparatus constructed in accordance with the present invention.
Figure 2:
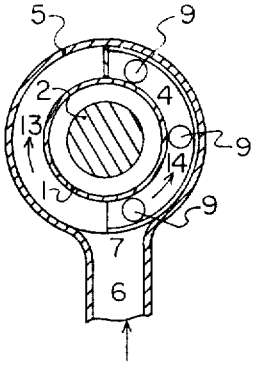
FIG. 2 is a sectional view along the lines of 2—2 of FIG. 1, looking in the direction of the arrows.

Referring now in detail to FIGS. 1 and 2 of the drawings, 1 is a stationary cylindrical body coaxially positioned with respect to a bearing-mounted rotatable shaft 2, which supports and rigidly connects hot-output disc 3 and cold-output disc 4 of the energy separator rotor for rotation with respect to surrounding stationary housing 5. In the configuration shown, body 1 houses the bearings which support shaft 2, but, as one alternative, the bearings could be placed elsewhere (for example, on shaft extensions beyond discs 3 and 4), or, as another alternative, fluid-film support of the rotor could be provided in the clearance gaps between housing 5 and discs 3 and 4. These clearance gaps are exaggerated in the figure for the sake of clarity, but in fact leakage through them is to be minimized.

6 is the input fluid supply duct, and 7 is the input port. 8 and 9 are rotor discharge passages extending through discs 3 and 4, respectively, for discharging fluids in the direction of arrows A and B, respectively. The total discharge area of passages 9 is greater than that of passages 8, and the ratio of the two areas is so proportioned that under the combined action of the issuing jets the rotor periphery moves at a predetermined velocity in the direction of arrows C. Thus, in a coordinate system fixed to housing 5, the total specific energy of the jets issuing through passages 8 is higher, and that of the jets issuing through passages 9 is lower, than that of the input flow, in accordance with the theory set forth in my U.S. Pat. No. 3,361,336. 10 is a substantially helicoidal baffle, extending radially from the outer surface of body 1 to the inner surface of housing 5, and of pitch almost equal to the distance between discs 3 and 4. The edges 11 and 12 of baffle 10 are welded or otherwise secured to body 1 and to housing 5, respectively. Baffle 10 divides the space between body 1 and housing 5 into two tapered conduits 13 and 14, and the input flow, on being fed into this space through port 7, is divided by body 1 into two flows, one of which is constrained to acquire a negative prerotation as it enters conduit 13, which leads it to the hot-discharge disc, while the other is imparted a positive prerotation as it enters conduit 14, which leads it to the cold-discharge disc. The tapering of the conduits tends to compensate for the fact that the mass flow rate decreases in each in the direction of the flow, and contributes, therefore, to the maintenance of a constant rate of flow through the discharge orifices on each side and to the reduction of fluctuations and losses in both flows.

The characterization of baffle 10 as "substantially helicoidal" is intended to describe a configuration similar to a helix but with such departures from an exact helix and with such variations of thickness along its length as may be deemed desirable to produce a better flow on each side. Baffle 10 may also perform the structural function of supporting body 1, whether or not this body houses the bearing assembly which supports shaft 2.

Figure 3:
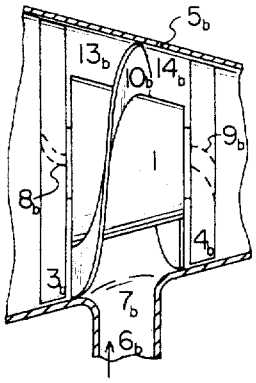
FIG. 3 shows, in diagrammatic form, another illustration of apparatus for energy separation with dual prerotation in accordance with the present invention.

FIG. 3 shows an arrangement in which the centerline of the prerotation channel follows a path which is a modified helix or spiral. Components shown in FIG. 3 corresponding to similar components in FIGS. 1 and 2 have been given the same reference numbers with the subscript *b*.

Figure 4:
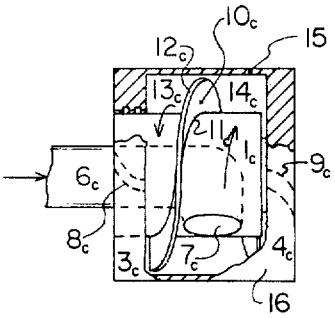
FIGS. 4 and 5 are side elevational views, partially in section and broken away for convenience, of other embodiments of apparatus for carrying out the present invention.

In the arrangement shown in FIG. 4, enshrouding wall 15 corresponds to enshrouding wall 5 of the arrangement shown in FIG. 1 but is part of the rotor 16 and connects the two rotor discharge ends 3*c* and 4*c*. Therefore, baffle $10_c$ is not attached along its edge $12_a$ to wall 15, but its inner edge $11_c$ is attached to stationary member $1_c$. The fluid supply duct $6_c$ extends through the interior of body $1_c$ and feeds the input flow radially outwardly, through port $7_c$, into conduits $13_c$ and $14_c$.

Figure 5:
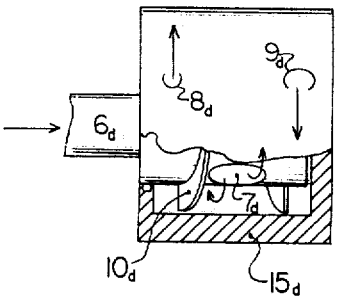

In FIG. 5, there is shown an arrangement similar to that shown in FIG. 4, in which, however, the hot and cold flows discharge through nozzles $8_d$ and $9_d$ in the enshrouding portion $15_d$ of the rotor. Nozzles $8_d$ and $9_d$ have substantially opposite orientations and are placed in two different planes of rotation, on opposite sides of port $7_d$, thus making possible the separate collection of the two issuing flows, through separate collectors. Baffle $10_d$ is attached along its inner edge to stationary body $1_d$.

Figure 6:
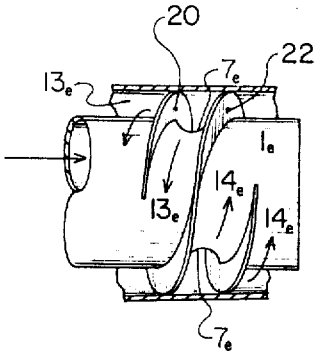
FIG. 6 is a side elevational view, partially in section, of yet another embodiment of apparatus suitable for carrying out the present invention.

FIG. 6 shows the central portion of an arrangement similar to those shown in FIGS. 4 and 5, in which, however, two helicoidal channels $13_e$ and $14_e$ are formed by two helicoidal baffles 20 and 22 positioned with respect to one another in the manner of the threads of a multi-threaded screw. Each of the two channels is fed through one of the two ports $7_e$ discharging radially outwardly from the interior of member $1_e$ at diametrically opposite sides. It is clear that the two channels could, alternatively, be fed inwardly from ports in the enshrouding wall, as in the arrangement shown in FIG. 1. It is also clear that three ports could discharge into three helical conduits in a similar multi-threaded screw arrangement, and so on.

It is to be understood that in all of the above-described embodiments of apparatus for carrying out this invention each group of nozzles or openings may be replaced by a cascade. The two groups may differ from one another in the size, number, radial position, and orientation of the discharge openings. It is also obvious that various modifications of the embodiments described are possible within the scope of the invention claimed.

In the following, the designations "helicoidal" and "spiral" will be used interchangeable, in accordance with common usage and with the definitions of these words given, e.g., in the Random House Dictionary of the English language.

I claim:

1. The method of dividing a first flow of a fluid into two subflows while simultaneously imparting to said subflows angular momenta of opposite signs, comprising feeding said first flow transversely into, and at some location along, a conduit formed by the space between two coaxial surfaces of revolution and generally helicoidal stationary surfaces substantially spanning said space, whereby one of said subflows flows in one direction away from said location and the other of said subflows flows in the other direction away from said location, and said subflows are, by virtue of said geometry, constrained to acquire angular momenta of opposite signs.

2. The method of dividing the fluid input to an internal-separation energy separator having energizing and deenergizing components into two flows while simultaneously imparting to said flows angular momenta of opposite signs, comprising feeding said input transversely, and at some location along, a substantially helicoidal stationary conduit leading in one direction away from said location to the energizing component and in the other direction away from said location to the de-energizing component of said energy separator, whereby the portion of said fluid which flows toward said energizing component and the portion of said fluid which flows toward said de-energizing component are constrained to acquire angular momenta of opposite signs.

3. A device for dividing the fluid input to an internal-separation energy separator into two flows while simultaneously imparting to said two flows angular momenta of opposite signs, and for reducing fluctuations and losses in said two flows, comprising a substantially helicoidal stationary conduit, means for supplying said fluid transversely into said conduit at some location along its length, said energy separator having energizing and de-energizing discharges, said conduit leading in one direction away from said location to said energizing discharge and in the other direction away from said location to said de-energizing discharge, whereby the portion of said fluid which flows toward said energizing discharge and that which flows toward said de-energizing discharge are constrained to acquire angular momenta of opposite signs.

4. A device for dividing the fluid input to an internal-separation energy separator having a rotor with energizing and de-energizing components into two flows while simultaneously imparting to said two flows angular momenta of opposite signs, and for reducing fluctuations and losses in said two flows, comprising means defining two surfaces of revolution coaxially positioned with respect to said rotor, a generally helicoidal stationary partition substantially spanning the space between said two surfaces and defining a passage between said surfaces and said partition, said passage leading in one direction toward said energizing component and in the opposite direction toward said de-energizing component, the orientation of said partition being such that the angular momentum acquired by particles advancing within said passage toward said de-energizing component is of the same sign as the angular velocity of said rotor while the angular momentum acquired by particles advancing within said passage toward said energizing component is of the opposite sign, and means for feeding said fluid input transversely into, and at some location along, said passage.

5. A device for dividing the input flow to an internal-separation energy separator having a rotor with energizing and de-energizing components into two flows while simultaneously imparting to said two flows angular momenta of opposite signs, and for reducing fluctuations and losses in said two flows, comprising a stationary inner body and a stationary outer body laterally enshrouding said inner body, the outer surface of said inner body and the inner surface of said outer body being substantially coaxially positioned with respect to said rotor, the space between said surfaces leading in one axial direction to said energizing component and in the opposite direction to said de-energizing component, a substantially helicoidal stationary partition laterally spanning said space, thereby forming with said surfaces a substantially helicoidal stationary conduit in said space, means for supplying said input flow transversely into said conduit at a location between its two ends, whereby the portion of said fluid which flows toward said energizing component is constrained to acquire an angular momentum of sign opposite to that acquired by the portion of said fluid which flows toward said de-energizing component.

6. A device as set forth in claim 4, in which said input flow is supplied to a plurality of substantially helicoidal conduits formed in said space by said surface and a plurality of substantially helicoidal partitions.

7. A device as set forth in claim 4, in which said energizing component is a compressor and said de-energizing component is a turbine.

8. A device as set forth in claim 4, in which said energizing component is a pump and said de-energizing component is a turbine.

* * * * *